US010187931B2

(12) United States Patent
Kroetz et al.

(10) Patent No.: US 10,187,931 B2
(45) Date of Patent: Jan. 22, 2019

(54) INDUCTIVE HARDENING MACHINE

(71) Applicant: EMAG Holding GmbH, Salach (DE)

(72) Inventors: Harry Kroetz, Schiltach (DE); Manuel Mueller, Dunningen-Seedorf (DE)

(73) Assignee: EMAG HOLDING GMBH, Salach (DE)

( * ) Notice: Subject to any disclaimer, the term of this patent is extended or adjusted under 35 U.S.C. 154(b) by 189 days.

(21) Appl. No.: 15/066,328

(22) Filed: Mar. 10, 2016

(65) Prior Publication Data

US 2016/0278169 A1 Sep. 22, 2016

(30) Foreign Application Priority Data

Mar. 21, 2015 (DE) ..... 10 2015 003 797

(51) Int. Cl.
*H05B 6/10* (2006.01)
*H05B 6/22* (2006.01)

(52) U.S. Cl.
CPC ..... *H05B 6/102* (2013.01)

(58) Field of Classification Search
CPC . H05B 6/06; H05B 6/10; H05B 6/101; H05B 6/102; H05B 6/36; H05B 6/38; H05B 6/40; H05B 6/42; H05B 6/44
USPC ..... 219/635, 652, 653, 655, 656, 660, 662, 219/670, 671, 672, 676, 639; 266/78, 79, 266/90, 103, 129, 249, 252
See application file for complete search history.

(56) References Cited

U.S. PATENT DOCUMENTS 3,525,842 A * 8/1970 Steinhoff ..... C21D 9/38 219/639
3,967,089 A * 6/1976 Seulen ..... C21D 1/63 219/639
RE33,467 E * 12/1990 Steck ..... B29C 65/3656 219/675

FOREIGN PATENT DOCUMENTS

DE 3836268 B 10/1988

* cited by examiner

*Primary Examiner* — Hung D Nguyen
(74) *Attorney, Agent, or Firm* — Andrew Wilford

(57) ABSTRACT

A machine for inductively hardening a workpiece has a stationary frame, a holder on the frame adapted to secure the workpiece in a workspace, and a control housing fixed on the frame and containing a transformer. A slide is movable on the frame relative to the workspace and carries an inductor juxtaposable with the workpiece in the workspace. A flexible high-current cable extends between the fixed transformer and the movable slide for feeding electricity from the transformer to the inductor.

9 Claims, 1 Drawing Sheet

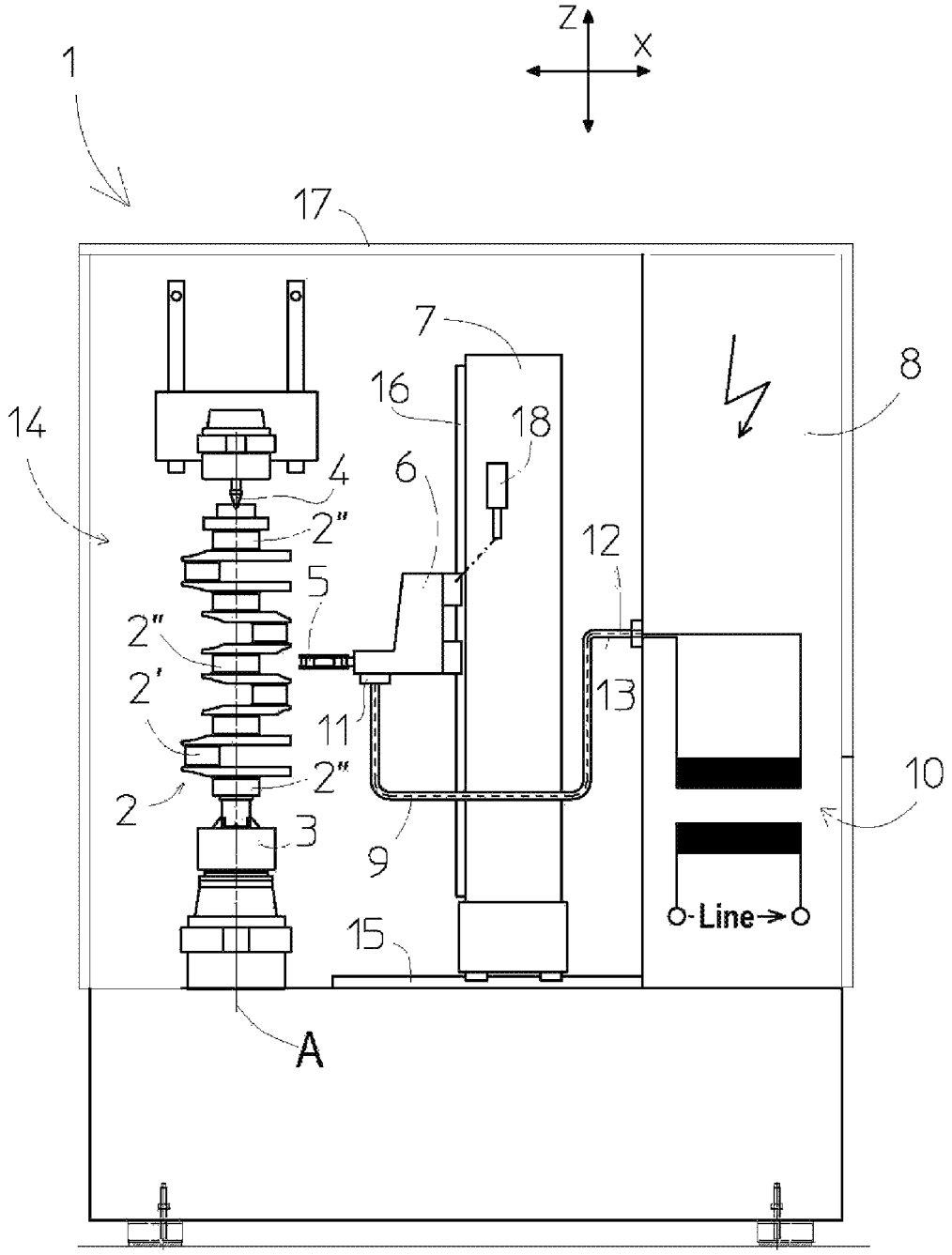
Z
X
1
17
7
8
16
18
14
4
6
2"
12
5
2"
13
2'
11
2"
10
2
3
9
Line
15
A

INDUCTIVE HARDENING MACHINE

FIELD OF THE INVENTION

The present invention relates to an inductive hardening machine. More particularly this invention concerns such a machine used to harden the crankpins and/or bearings of a camshaft.

BACKGROUND OF THE INVENTION

For inductively hardening the bearings of a crank shaft it is standard as described in German patent 3,836,268 and U.S. Pat. No. 3,967,089 to mount the crankshaft in a workpiece holder that typically has a headstock and tailstock for gripping the crankshaft and rotating it in a work space about its bearing axis. A transformer supplies alternating current to an inductor that is shaped to fit around the bearing of the rotating workpiece. The inductor can be moved axially and also radially of the workpiece's rotation axis so that it can be fitted with the bearings one after the other to inductively heat them in a standard hardening operation, often followed by quenching with a liquid.

The transformer serving as power supply for the inductor has a primary connected to line and a secondary connected to the inductor. Since the wattage applied to the inductor is very high, this transformer is relatively massive.

This power supply is mounted in the slide or carriage that also carries the inductor, or a fitting that can be hold any of a plurality of inductors differently shaped for bearings of different diameters and/or axial lengths. This slide must be moved along the crankshaft from bearing to bearing so the inductor can do its job, which requires that the slide have a very precise and strong actuator to ensure fast and accurate positioning. Hence the entire slide assembly, which includes the power transformer, and its actuator are very massive.

OBJECTS OF THE INVENTION

It is therefore an object of the present invention to provide an improved inductive hardening machine.

Another object is the provision of such an improved inductive hardening machine that overcomes the above-given disadvantages, in particular whose inductor slide or carriage is of reduced dimensions so that it can be accurately and easily positioned in the workspace and can easily be moved therein as it travels from bearing to bearing.

SUMMARY OF THE INVENTION

This object is attained in a machine for inductively hardening a workpiece that has a stationary frame, a holder on the frame adapted to secure the workpiece in a workspace, and a control housing fixed on the frame and containing a transformer. A slide is movable on the frame relative to the workspace and carries an inductor juxtaposable with the workpiece in the workspace. According to the invention a flexible high-current cable extends between the fixed transformer and the movable slide for feeding electricity from the transformer to the inductor.

Thus the transformer is not moved with the inductor, so that the entire assembly of inductor and slide can be relatively light. The inductor can therefore be moved quickly and easily along the workpiece to harden its bearings.

The control housing and transformer in accordance with the invention are outside the workspace. The heat generated by the transformer can therefore be easily dealt with, without taking up usable space where the machine actually is working.

The cable according to the invention is a flexible coaxial cable. It engages a fitting on the slide through which it is connected to the inductor.

The holder of this invention includes means such as a headstock and tailstock for rotating the workpiece about an axis in the workspace. In addition a tower is provided on the frame adjacent the workspace, and the slide is carried and movable on this tower. A guide rail is provided on the frame for movement of the tower on the frame relative to the workspace, and the tower is movable horizontally relative to the workspace and the slide is moveable vertically on the tower. Finally, the tower carrying the slide is between the control housing and the workspace.

BRIEF DESCRIPTION OF THE DRAWING

The above and other objects, features, and advantages will become more readily apparent from the following description, reference being made to the accompanying drawing whose sole FIGURE is a schematic view of an inductive hardening machine according to the invention.

SPECIFIC DESCRIPTION OF THE INVENTION

As seen in the drawing, a hardening machine 1 has a frame 17 provided with a headstock 3 and tailstock 4 that can hold a workpiece, here a crankshaft 2 having crankpins 2' and bearings 2", in a workspace 14 and rotate it about a here vertical axis A that passes centrally through the bearings 2". Adjacent the workspace 14 is a column 7 movable horizontally in a direction x on rails 15 of the machine 1 toward and away from the workspace 14. This column 7 carries vertical rails 16 on which a mount 6 carrying a saddle-shaped inductor 5 can travel in a direction z along the axis A of the workspace 14.

According to the invention a stationary control housing 8 is fixed on the frame 17 of the machine 1 and holds a massive transformer 10 that converts incoming line voltage to alternating current of the amperage, frequency, and voltage required by the inductor 5. This current passes through a flexible coaxial cable 9 from the stationary control housing 8 to a fitting 11 on the tool mount 6, and thence passes to the inductor 5. The coaxial cable 9 has a conductive core 12 surrounded by a conductive sheath 13.

Since the cable 9 is flexible, the tower 7 and mount 6 can move quickly and freely to juxtapose the inductor 5 with the bearings 2" and inductively heat them, while the heavy transformer 10 sits in the control housing 8, which can be provided with an appropriate coolant system for the transformer 10.

The fact that this transformer 10 does not have to be moved, allows actuators, such as shown schematically at 18, for the slide 6 and tower 7 to be relatively small and fast-acting.

We claim:

1. A machine for inductively hardening a workpiece, the machine comprising:

a stationary frame;

a holder on the frame adapted to secure the workpiece in a workspace;

a control housing fixed on the frame;

a transformer fixed in the control housing connectable to line for converting incoming line voltage to an alternating-current output voltage of a predetermined amperage, frequency, and voltage;

a slide movable on the frame relative to the workspace and to the workpiece therein;

an inductor carried on the slide and juxtaposable with the workpiece in the workspace; and a flexible high-current cable extending between the fixed transformer and the movable slide for feeding the output voltage from the transformer to the inductor.

2. The hardening machine defined in claim 1, wherein the control housing and transformer are outside the workspace.

3. The hardening machine defined in claim 1, wherein the cable is a coaxial cable.

4. The hardening machine defined in claim 1, further comprising a fitting on the slide through which the cable is connected to the inductor.

5. The hardening machine defined in claim 1, wherein the holder includes means for rotating the workpiece about an axis in the workspace.

6. The hardening machine defined in claim 1, further comprising:

a tower on the frame adjacent the workspace, the slide being carried and movable on the tower.

7. The hardening machine defined in claim 6, further comprising:

a guide on the frame for movement of the tower on the frame relative to the workspace.

8. The hardening machine defined in claim 7, wherein the tower is movable horizontally relative to the workspace and the slide is moveable vertically on the tower.

9. The hardening machine defined in claim 6, wherein the tower is between the control housing and the workspace.

* * * * *